US008199063B2

(12) United States Patent
Moon et al.

(10) Patent No.: US 8,199,063 B2
(45) Date of Patent: Jun. 12, 2012

(54) DUAL-BAND DUAL-POLARIZED BASE STATION ANTENNA FOR MOBILE COMMUNICATION

(75) Inventors: Young-Chan Moon, Gyeonggi-do (KR); Sung-Hwan So, Gyeonggi-do (KR)

(73) Assignee: KMW Inc. (KR)

( * ) Notice: Subject to any disclaimer, the term of this patent is extended or adjusted under 35 U.S.C. 154(b) by 339 days.

(21) Appl. No.: 12/440,630

(22) PCT Filed: Sep. 5, 2007

(86) PCT No.: PCT/KR2007/004277

§ 371 (c)(1), (2), (4) Date: Mar. 10, 2009

(87) PCT Pub. No.: WO2008/032951

PCT Pub. Date: Mar. 20, 2008

(65) Prior Publication Data

US 2009/0278759 A1 Nov. 12, 2009

(30) Foreign Application Priority Data

Sep. 11, 2006 (KR) ..... 10-2006-0087692

(51) Int. Cl.
*H01Q 21/00* (2006.01)
*H01Q 9/16* (2006.01)

(52) U.S. Cl. ..... 343/810; 343/793; 343/797; 343/798

(58) Field of Classification Search ..... None
See application file for complete search history.

(56) References Cited

U.S. PATENT DOCUMENTS 4,434,425 A 2/1984 Barbano
5,589,843 A * 12/1996 Meredith et al. ..... 343/820
6,333,720 B1 12/2001 Gottl
6,822,618 B2 11/2004 Bisiules et al.
7,075,498 B2 * 7/2006 Gottl et al. ..... 343/797
7,079,083 B2 * 7/2006 Gottl et al. ..... 343/797
7,629,939 B2 * 12/2009 Deng et al. ..... 343/821
7,688,271 B2 * 3/2010 Cao et al. ..... 343/797
2004/0108956 A1 * 6/2004 Gottl et al. ..... 343/700 MS
2004/0140942 A1 7/2004 Gottl
2005/0264463 A1 12/2005 Gottl et al.
2006/0114168 A1 6/2006 Gottl et al.

FOREIGN PATENT DOCUMENTS

DE 19860121 A1 7/2000

(Continued)

OTHER PUBLICATIONS

Japanese Patent Office, Examination Report re: Japanese Patent Application 2009-528173, May 24, 2011.

*Primary Examiner* — Trinh Dinh

(57) ABSTRACT

Disclosed is a dual-band dual-polarized antenna for a mobile communication base station, which includes: a reflection plate; a first radiation device module for transmitting and receiving two linear orthogonal polarizations for a first frequency band, the first radiation device module generally having a square shape, the first radiation device module including a plurality of dipoles arranged to form the square shape, each of the dipoles substantially having a transverse side and a vertical side; and a second radiation device module for a second frequency band which is arranged within the square shape of the first radiation device module, and includes a plurality of dipoles generally arranged to form a cross-shape.

3 Claims, 9 Drawing Sheets

FOREIGN PATENT DOCUMENTS

| | | | |
|---|---|---|---|
| JP | 2001-284946 | A | 10/2001 |
| JP | 2002-319815 | A | 3/2004 |
| JP | 2005-203962 | A | 3/2004 |
| JP | 2005-20715 | A | 1/2005 |
| JP | 2005-033261 | A | 2/2005 |
| JP | 2005-516513 | A | 6/2005 |
| WO | 03/065505 | A1 | 8/2003 |
| WO | 2004/055938 | A2 | 7/2004 |

* cited by examiner

DUAL-BAND DUAL-POLARIZED BASE STATION ANTENNA FOR MOBILE COMMUNICATION

RELATED APPLICATIONS

This application is a 371 of PCT/KR07/04277 filed Sep. 5, 2007, which claims priority under 35 U.S.C. 119 to an application Republic of Korean 10-2006-0087692 filed Sep. 11, 2006, the contents of which are incorporated herein by reference.

TECHNICAL FIELD

The present invention relates to a base station antenna for mobile communication (a PCS, a Cellular, IMT-2000, etc.), and more particularly to a dual-band dual-polarized diversity antenna.

BACKGROUND ART

A base station antenna for mobile communication is designed by means of a space diversity scheme or a polarization diversity scheme so as to reduce a fading phenomenon. A space diversity scheme means to install a transmitting antenna and a receiving antenna while being spaced a predetermined distance from each other, and has a large limit in space and a disadvantage in cost. Accordingly, a mobile communication system has typically used a dual-band dual-polarized antenna to which a polarized diversity scheme is applied.

A dual-band dual-polarized antenna is used to transmit (or receive) two linear polarizations which are arranged rectangular to each other, e.g. which can be vertically and horizontally arranged, respectively. However, it is very important to operate the dual-band dual-polarized antenna so as to allow these polarizations to be arranged at +45 degrees and at −45 degrees respective to a vertical direction (or a horizontal direction). Generally, a dual-band dual-polarized antenna is operated in two frequency bands which are sufficiently spaced apart from each other. An embodiment of such a dual-band dual-polarized antenna is disclosed in the U.S. Pat. No. 6,333,720 (title: dual-polarized multi-range antenna) filed by Kathrein-Werke.

FIG. 1 is a perspective view illustrating an embodiment of an array of a conventional dual-band dual-polarized antenna, which is the same as what is disclosed in the U.S. Pat. No. 6,333,720. With reference to FIG. 1, a conventional dual-band dual-polarized antenna includes the first radiation device module 1 for the first frequency band (a lower frequency band, hereinafter, referred to as a low frequency band) and the second radiation device module 3 for the second frequency band (a higher frequency band, hereinafter, referred to as a high frequency band).

Two radiation device modules 1 and 3 are arranged on a conductive reflection plate 5 having a substantially square shape. A feeding network can be positioned at a rear surface of the conductive reflection plate 5 so that each of the first and second radiation device modules 1 and 3 is electrically connected. The first radiation device module includes a plurality of dipoles 1*a* generally arranged to form an square shape, and the dipoles 1*a* are mechanically supported by a reflection plate 5 or a plate positioned at the rear place thereof by means of what is called a balancer 7, and also make electric contact therewith. At this time, the reflection plate 5 has side walls 6, which extend from a corresponding plane while having a proper height, at both edges thereof so as to improve a radiation characteristic.

A dipole device of the first radiation device module 1 has a set length so as to allow corresponding electromagnetic waves to be transmitted and received through the corresponding dipole device. Therefore, in the dual-polarized antenna, dipole devices are exactly arranged while meeting at right angles. Typically, each of the dipole devices 1*a* is arranged at +45 and −45 degrees respective to the vertical direction (or respective to a horizontal direction) so that they form an antenna which is briefly named an X-polarized antenna.

The second radiation device module 3 can be positioned within the first radiation device module 1 having a square shape formed by dipoles or at the exterior thereof. Such a second radiation device module 3 has dipoles which are arranged not to form a square shape but to form a cross-shape. Similarly, two dipoles 3*a* positioned at a right angle to each other are supported by the reflection plate 5 by means of a corresponding balance net, and are fed with power through it.

The first and second radiation device modules 1 and 3 are exactly arranged at proper positions on the reflection plate 5. At this time, the second radiation device module is arranged within the first radiation device module 1. Also, as shown in FIG. 1, two antenna apparatuses formed by such first and second radiation device modules 1 and 3 can be installed at the reflection plate 5 in a vertical direction, and the second separated radiation device module 3◎ of the second frequency band can be installed in the space between the two antenna apparatuses, thereby obtaining high vertical benefit through such an arrangement scheme.

However, in the structure of the antenna as shown in FIG. 1, it is difficult to install a side wall so as to adjust the width of a beam. Particularly, a mobile communication station is divided into three sectors, and the width of the beam of a sector antenna is adjusted at 65 degrees or 90 degrees. So as to secure the width of the beam at 65 degrees, it is adjusted by the selection of a radiation device, the distance between side walls, and the height of the side walls. The structure of the antenna as shown in FIG. 1, a square-shaped radiation device of a low frequency band is arranged to form a rhombic shape respective to a vertical direction, so that if a side wall is escaped from the radiation device in a high degree, or if a side wall is adjusted to the size of radiation device, the size of the side wall becomes larger. As the side wall is near the radiation device, it is easy to adjust the width of the beam thereof. Therefore, it is difficult to simultaneously adjust the low frequency band and high frequency band to the width of the beam at 65 degrees.

Accordingly, in the conventional dual-band dual polarized antenna, it is difficult to adjust the width of the beam so that the characteristic of the antenna, e.g. separation degree and cross deviation, are deteriorated so as to firstly adjust the width of the beam.

DISCLOSURE

Technical Problem

The present invention has been made to solve the above-mentioned problems occurring in the prior art, and the present invention provides a dual-band dual-polarized antenna used as a base station antenna for mobile communication, which allows the width of a beam to be easily adjusted, and can be designed in an easy manner.

Technical Solution

In accordance with an aspect of the present invention, there is provided a dual-band dual-polarized antenna for a mobile communication base station, which includes: a reflection plate; a first radiation device module for transmitting and receiving two linear orthogonal polarizations for a first frequency band, the first radiation device module generally having a square shape, the first radiation device module including a plurality of dipoles arranged to form the square shape, each of the dipoles substantially having a transverse side and a vertical side; and a second radiation device module for a second frequency band which is arranged within the square shape of the first radiation device module, and includes a plurality of dipoles generally arranged to form a cross-shape.

Advantageous Effects

As described above, in the dual-band dual-polarized antenna according to the present invention, the width of the beam is easily adjusted, and the antenna can be easily designed.

BEST MODE

Mode for Invention

Hereinafter, an exemplary embodiment of the present invention will be described with reference to the accompanying drawings. In the below description, particular items such as a specific constituent device are shown, but these are given only for providing the general understanding of the present invention, it will be understood by those skilled in the art that in such particular items, various changes in form and detail may be made within the scope of the present invention.

Figure 1:
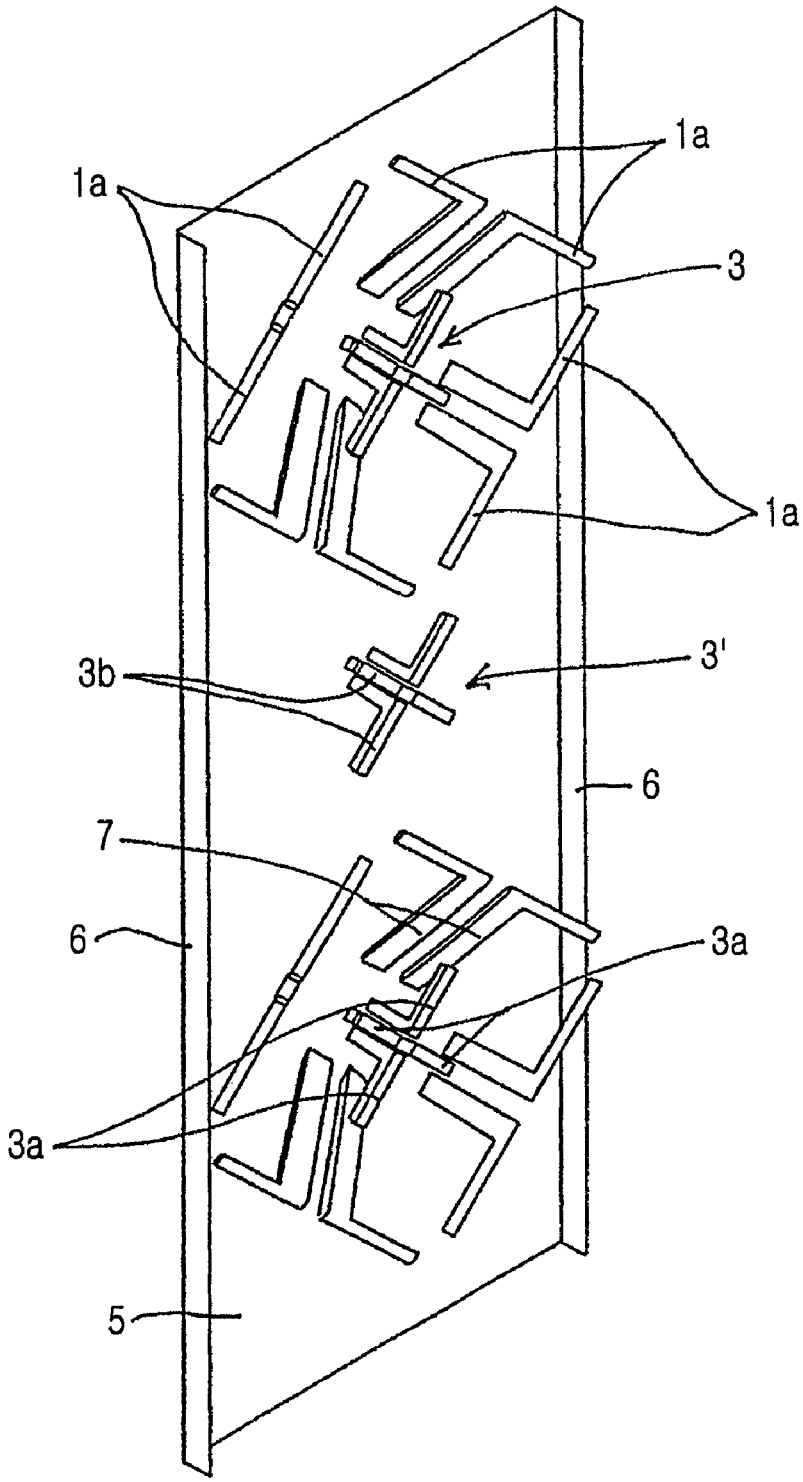
FIG. 1 is a perspective view illustrating the array of a conventional dual-band dual-polarized antenna.
Figure 2:
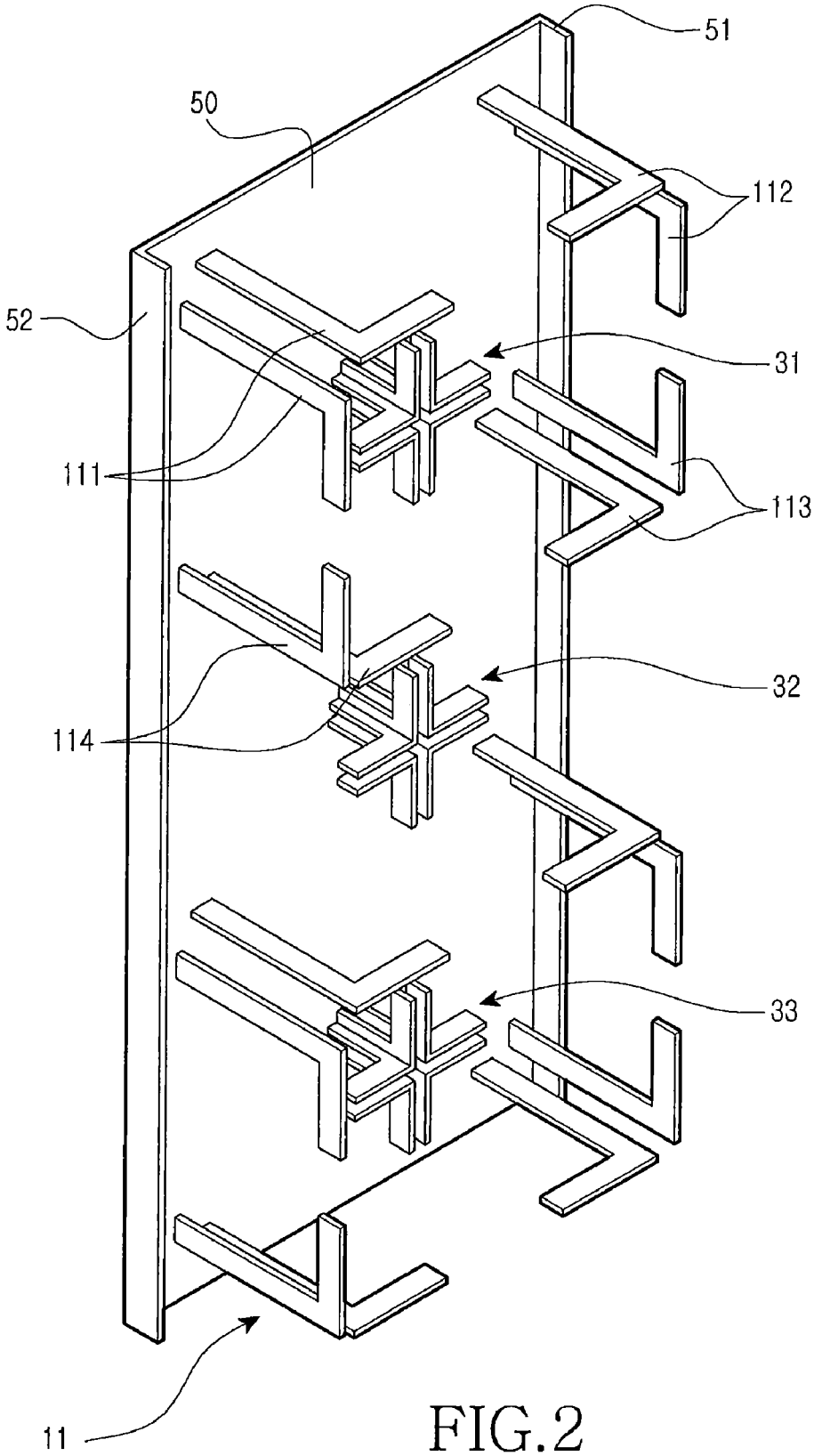
FIG. 2 is a perspective view illustrating the array of a dual-band dual-polarized antenna according to an embodiment of the present invention.

FIG. 2 is a perspective view illustrating the array of a dual-band dual-polarized antenna according to an embodiment of the present invention. With reference to FIG. 2, in the array of a dual-band dual-polarized antenna according to an embodiment of the present invention, two antenna apparatuses are are serially arranged in a vertical direction, which include the first radiation device module 11 of a low frequency band installed at a front surface of a reflection plate 50 similarly to the conventional art and the second radiation device module 31 of a high frequency band arranged within the first radiation device module 11. Furthermore, the second separated radiation device module 32 of the second frequency band is installed in the space between the two antenna apparatuses.

However, the detailed construction of each of the first and second radiation device modules 11 and 31 has a difference in comparison with the conventional construction. Particularly, although the entire shape of the first radiation device module 11 having a plurality of dipoles 111, 112, 113, and 114 is a square-shape, the square shape is not a conventional rhombic shape, but is substantially a regular square-shape having a transverse side and a vertical side.

Figure 3:
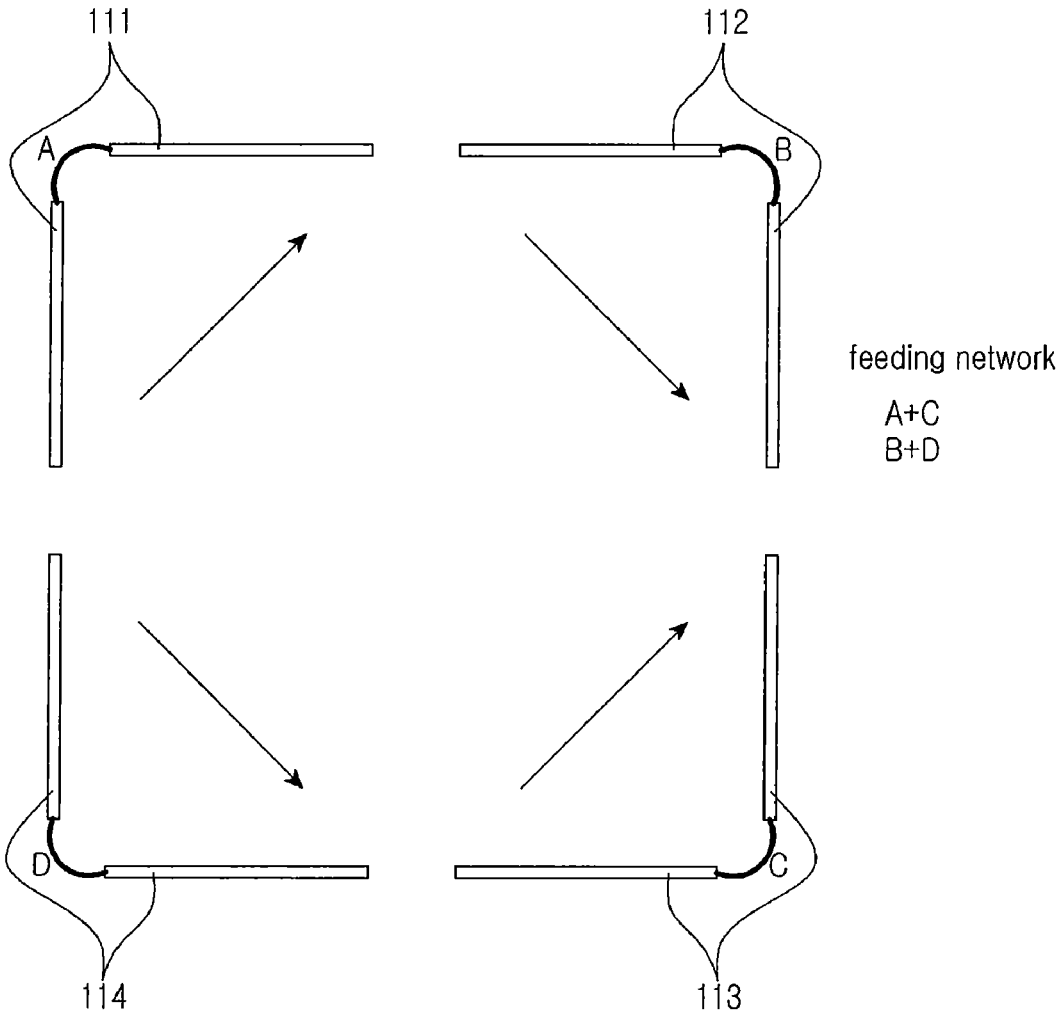
FIG. 3 is a view illustrating the structure of a radiation device for the first band in the array of a dual-band dual-polarized antenna according to an embodiment of the present invention.

FIG. 3 is a view illustrating the structure of a radiation device for the first band in the array of a dual-band dual-polarized antenna according to an embodiment of the present invention, which can show the structure of the first radiation device module 11 as shown in FIG. 2. As shown in FIG. 3, the first radiation device module according to an embodiment of the present invention includes a plurality of dipoles 111, 112, 113, and 114 which can generally form each vertex of a regular square, and each of them can have a shape bent at 90 degrees. In such a structure, so as to arrange two linear polarizations at +45 degrees and at −45 degrees, respective to a vertical direction (or a horizontal direction), and transmit (or receive) them, the plurality of dipoles 111, 112, 113, and 114 corresponding to each vertex of the regular square form a feeding network in such a manner that two dipoles positioned diagonal to each other make a pair with each other, i.e. 111+113 and 112+114.

Figure 4:
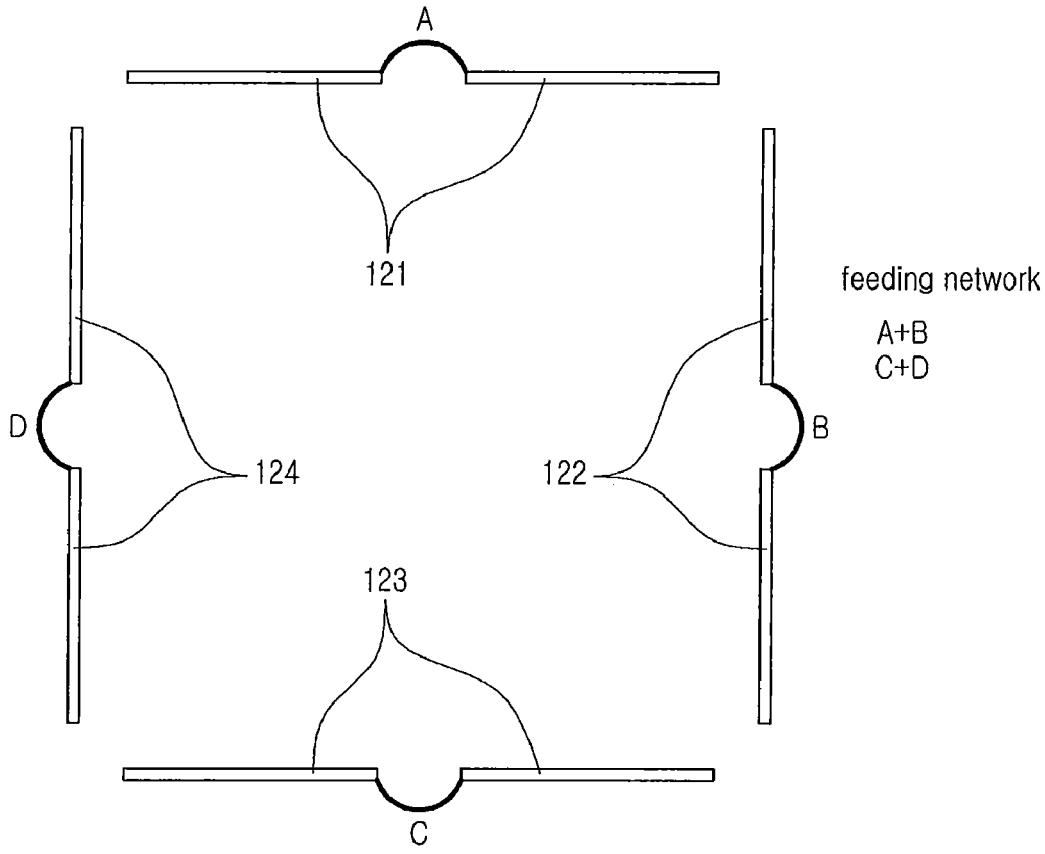
FIG. 4 is a view illustrating the structure of a radiation device for the second band in the array of a dual-band dual-polarized antenna according to another embodiment of the present invention.

FIG. 4 is a view illustrating the structure of a radiation device for the second band in the array of a dual-band dual-polarized antenna according to another embodiment of the present invention. With reference to FIG. 4, the first radiation device module according to another embodiment of the present invention includes a plurality of dipoles 121, 122, 123, and 124 which can generally form each side of a regular square. In such a structure, so as to arrange two linear polarizations at +45 degrees and at −45 degrees, respective to a vertical direction (or a horizontal direction), so as to transmit (or receive) them, dipoles corresponding to sides adjacent to each other make a pair with each other, i.e. 121+122 and 123+124, so as to form a feeding network.

Figure 5:
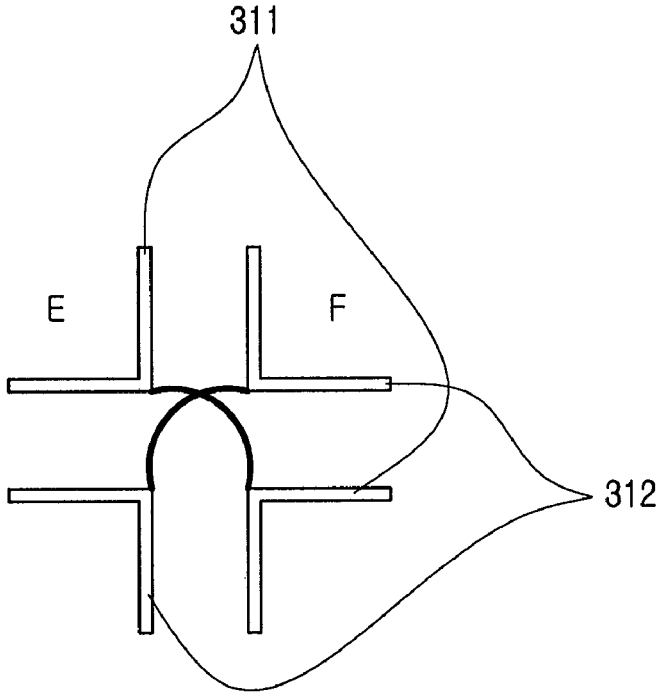
FIG. 5 is a view illustrating the structure of a radiation device for the second band in the array of a dual-band dual-polarized antenna according to an embodiment of the present invention.
Figure 6:
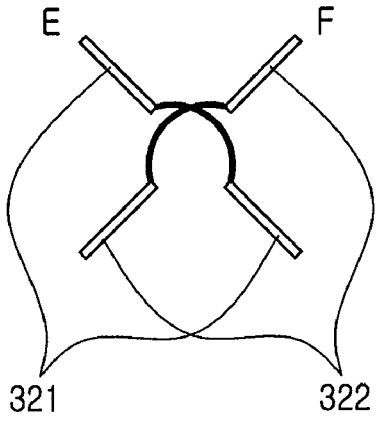
FIG. 6 is a view illustrating the structure of a radiation device for the second band in the array of a dual-band dual-polarized antenna according to another embodiment of the present invention.

FIG. 5 is a view illustrating the structure of a radiation device for the second band in the array of a dual-band dual-polarized antenna according to an embodiment of the present invention, which shows the structure of the second radiation device module 31 as shown in FIG. 2. FIG. 6 is a view illustrating the structure of a radiation device for the second band in the array of a dual-band dual-polarized antenna according to another embodiment of the present invention. The second radiation device module as shown in FIGS. 5 and 6 includes two dipoles 311/312 and 321/322 positioned per pendicularly to each other so as to form an entire cross-shape, and substantially, the entire shape of the second radiation device module as shown in FIG. 6 may be an "+" shape.

By properly combining the first and second radiation device modules having a structure as shown in FIGS. 3 to 6, a dual-band dual-polarized antenna can be structured. An embodiment of an general structure of such a dual-band dual-polarized antenna will be described in more detail with reference to the accompanying drawings.

Figure 7:
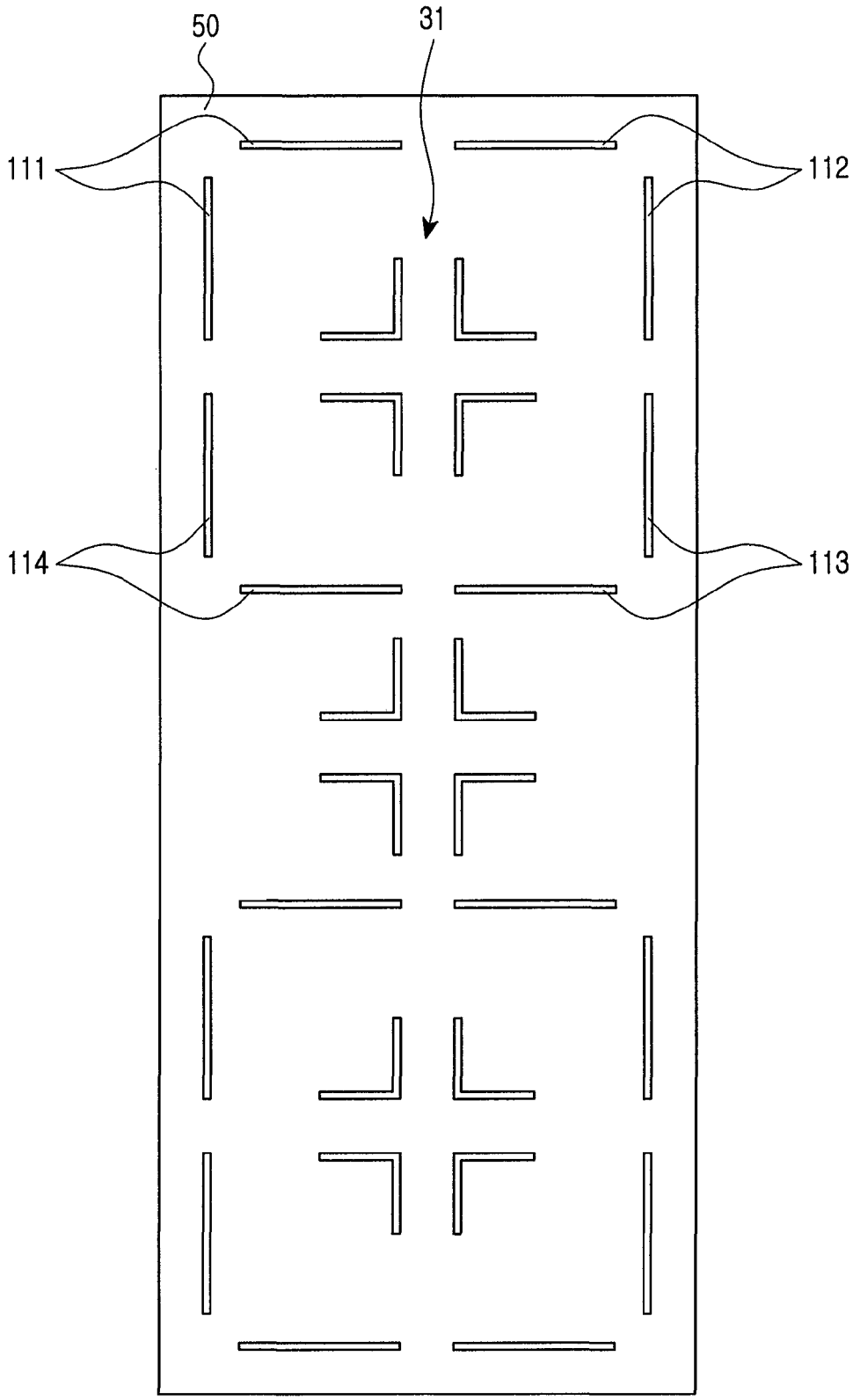
FIG. 7 is a view illustrating the structure of the array of a dual-band dual-polarized antenna according to another embodiment of the present invention.

FIG. 7 is a view illustrating the structure of the array of a dual-band dual-polarized antenna according to another embodiment of the present invention, which can be equal to the structure of the array of the dual-band dual-polarized antenna as shown in FIG. 2. Particularly, the first radiation device module as shown in FIG. 3 and the second radiation device module as shown in FIG. 5 are combined at two areas so as to form two antenna apparatuses. Similarly, the second radiation device module as shown in FIG. 5 is used as the separated second radiation device module.

Figure 8:
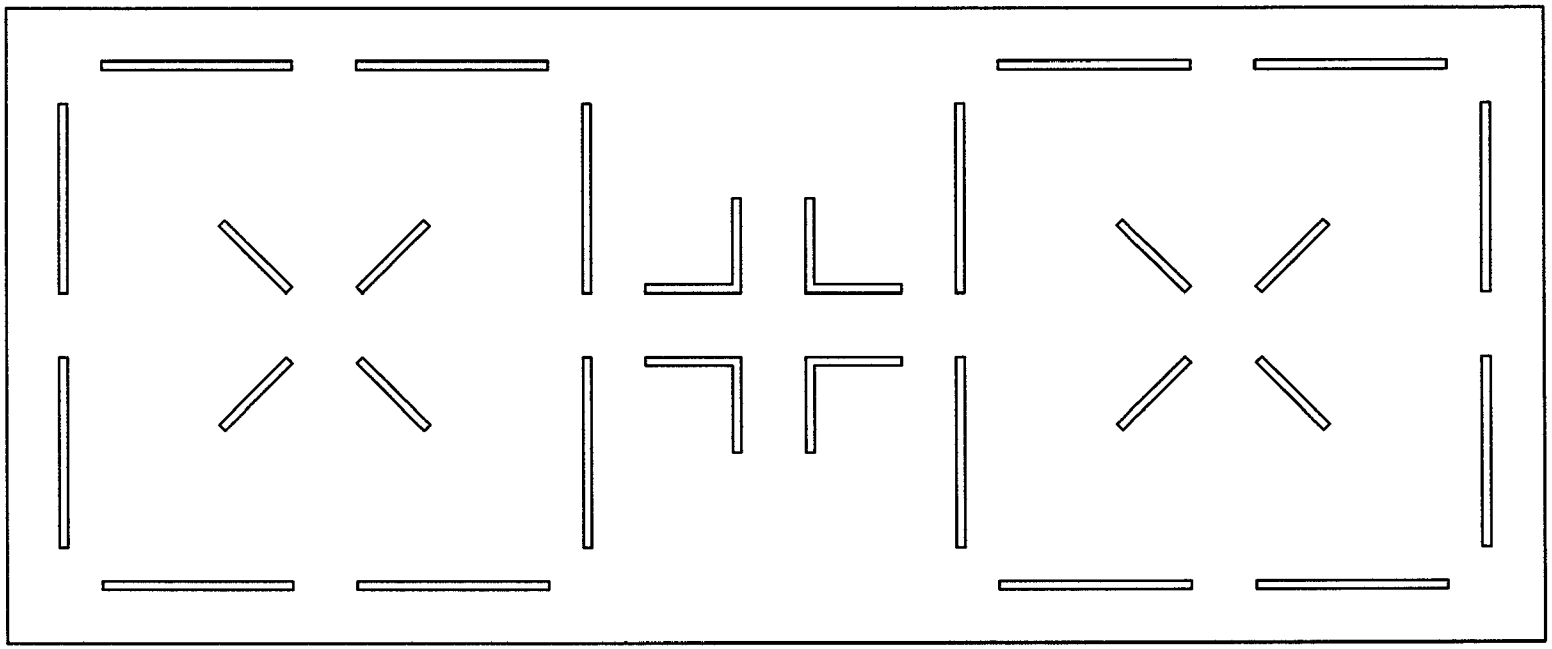
FIG. 8 is a view illustrating the structure of the array of a dual-band dual-polarized antenna according to another embodiment of the present invention.

FIG. 8 is a view illustrating the structure of the array of a dual-band dual-polarized antenna according to another embodiment of the present invention. In the structure as shown in FIG. 8, the first radiation device module as shown in FIG. 4 and the second radiation device module as shown in FIG. 6 are combined at two areas so as to form two antenna apparatuses, and the second radiation device module as shown in FIG. 5 is used as the separated second radiation device module.

The first and second radiation device modules having a structure as shown in FIGS. 3 to 6 according to the present invention are properly combined so as to form a dual-band dual-polarized antenna, which can be embodied in various forms.

At this time, the first and second radiation device modules generally have a square shape, which includes a plurality of dipoles arranged to form the square-shape substantially having a transverse side and a vertical side, so that a side wall of the reflection plate can be positioned near the radiation devices.

Therefore, the reflection plate can be a small size, and it is easy to design an antenna and adjust the width of the beam at 65 degrees in a low frequency band as well as the width of the beam at 65 degrees in a high frequency band.

Figure 9:
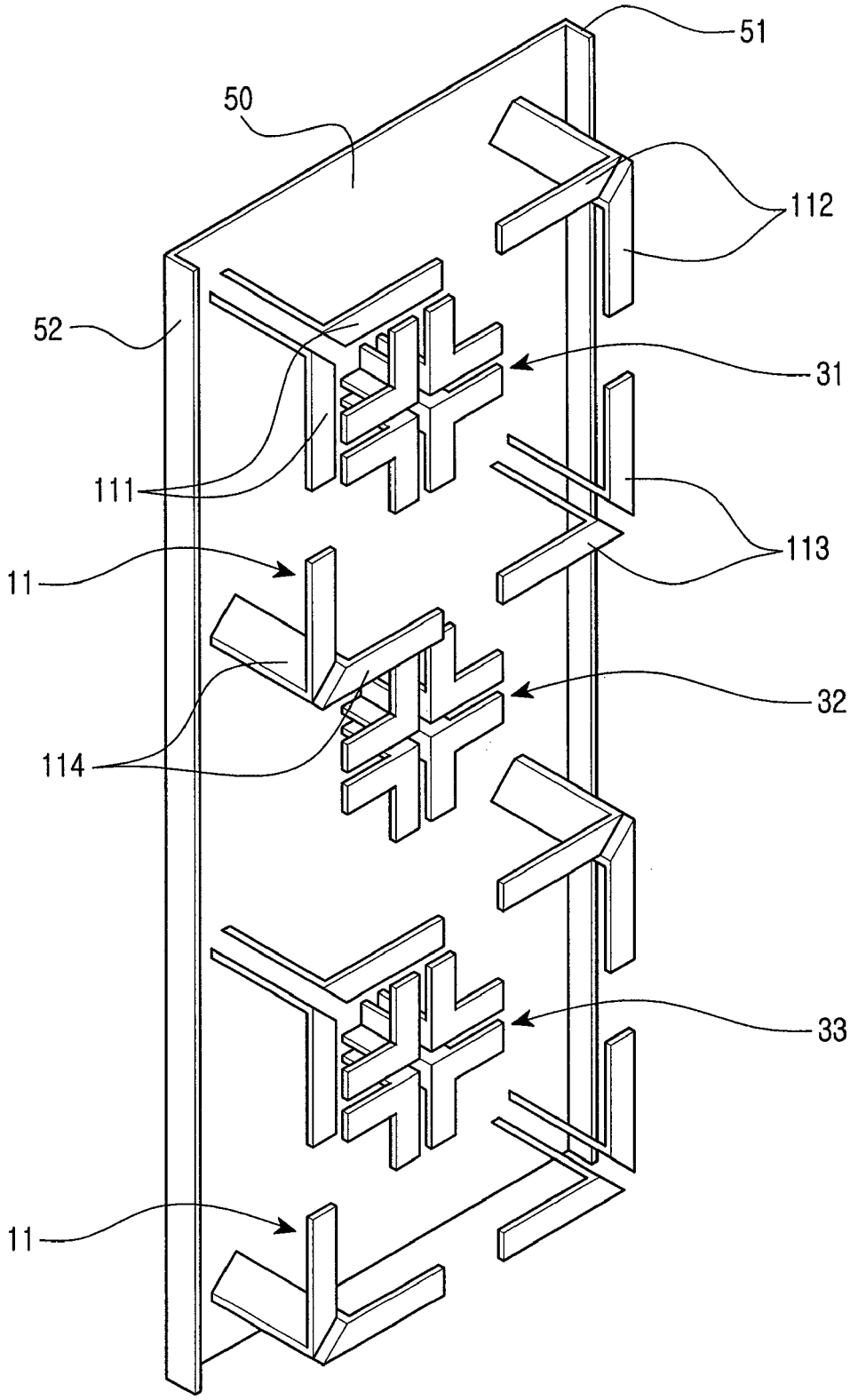
FIG. 9 is a perspective view illustrating a modified embodiment of the array of a dual-band dual-polarized antenna according to another embodiment of the present invention.

FIG. 9 is a perspective view illustrating a modified embodiment of the array of a dual-band dual-polarized antenna as shown in FIG. 2. The entire arrangement structures of the first and second radiation device modules 11 and 31 are equal to the structure as shown in FIG. 2, and the detailed structure of the plurality of dipoles 111, 112, 113, and 114 of respective the radiation device modules has a difference in comparison with the structure as shown in FIG. 2, which will be described with reference to FIGS. 10 and 11 in more detail.

Figure 10:
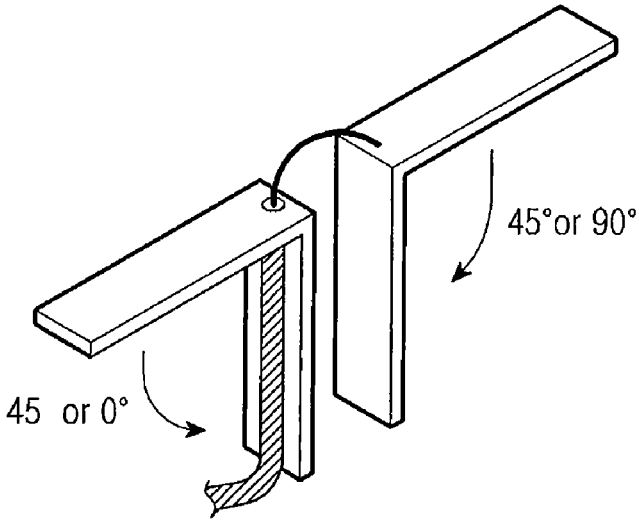
FIG. 10 is a view illustrating the detailed structure of a dipole of the radiation device module of FIG. 9.
Figure 11:
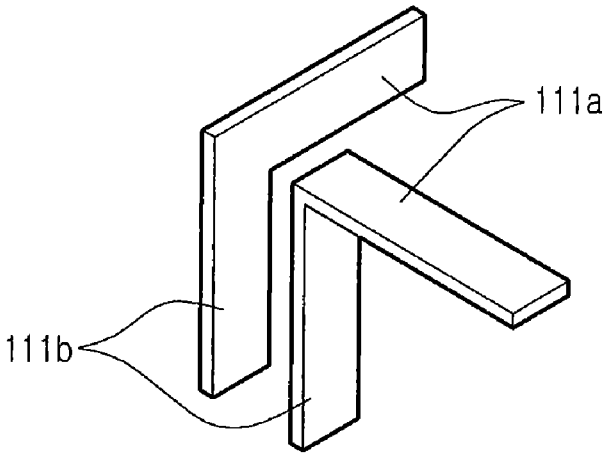
FIG. 11 is a view illustrating a modified embodiment of FIG. 10.

FIG. 10 is a view illustrating the detailed structure of a dipole of the radiation device module of FIG. 9, and FIG. 11 is a view illustrating a modified embodiment thereof. With reference to FIGS. 10 and 11, each of dipoles 111, 112, 113, and 114 is divided into a left end and a right end, and includes dipole devices 111*a* having a whole length properly designed according to a corresponding frequency and supporting parts of a proper shape supporting the left and right ends thereof, respectively.

Although the left and right ends of the dipole device 111*a* are linearly connected with each other (at 180 degrees) in FIG. 10, actually, the dipole device 111*a* may have a structure having the total angle of 90 degrees in such a manner that the left and right ends of the dipole device 111*a* are slanted against each other at 45 degrees on a plane as shown in FIG. 10. Also, the dipole device 111*a* may have a structure having the total angle of 90 degrees in such a manner that only one of the left and right ends of the dipole device 111*a* is slanted at 90 degrees.

Furthermore, as shown in FIG. 11, each dipole device 111*a* may be formed at the same plane at which the corresponding supporting part 111*b* is formed, or at the different plane, e.g. a plane having a right angle to the plane at which the corresponding supporting part is formed, and in this state, the dipoles devices are connected with each other.

As described above, the present invention is constructed and operated according to the embodiment of the present invention. Meanwhile, although an exemplary embodiment of the present invention has been described for illustrative purposes, those skilled in the art will appreciate that various modifications, additions and substitutions are possible, without departing from the scope and spirit of the invention. Accordingly, the scope of the invention is not to be limited by the above embodiments but by the claims and the equivalents thereof.

The invention claimed is:

1. A dual-band dual-polarized antenna for a mobile communication base station, comprising:

a reflection plate having a linear edge;

a first radiation device module for transmitting and receiving two linear orthogonal polarizations for a first frequency band, the first radiation device module generally having a square shape and including a plurality of dipoles arranged to form the square shape, wherein each of the dipoles comprises two dipole halves generally forming each vertex of the square shape and has a shape bent at 90 degrees, each of the dipoles substantially having a transverse side and a vertical side wherein the vertical side locates on the reflector plate, and in each of the dipoles, one of the dipole halves forms a side of the square shape with a dipole half of an adjacent dipole, and the other of the dipole halves forms another side of the square shape with a dipole half of another adjacent dipole, at least one of the sides of the square shape being parallel with the linear edge of the reflection plate; and a second radiation device module for a second frequency band which is arranged within the square shape of the first radiation device module, and includes a plurality of dipoles generally arranged to form a cross-shape.

2. A dual-band dual-polarized antenna for a mobile communication base station, comprising:

a reflection plate having a linear edge;

a first radiation device module for transmitting and receiving two linear orthogonal polarizations for a first frequency band, the first radiation device module generally having a square shape and including a plurality of dipoles arranged to form the square shape, wherein each of the dipoles comprises two dipole halves generally forming each vertex of the square shape and has a shape bent at 90 degrees, each of the dipoles substantially having a transverse side and a vertical side wherein the vertical side locates on the reflector plate, and in each of the dipoles, one of the dipole halves forms a side of the square shape with a dipole half of an adjacent dipole, and the other of the dipole halves forms another side of the square shape with a dipole half of another adjacent dipole, at least one of the sides of the square shape being parallel with the linear edge of the reflection plate; and a second radiation device module for a second frequency band which is arranged within the square shape of the first radiation device module, and includes a plurality of dipoles generally arranged to form a cross-shape; and antenna apparatuses installed on at least two areas of the reflection plate in a vertical direction.

3. The dual-band dual-polarized antenna for a mobile communication base station, as claimed in claim 2, wherein a separated second radiation device module of the second frequency band is formed between the antenna apparatuses installed on at least two areas of the reflection plate.

* * * * *